US007584846B2

(12) United States Patent
Senter

(10) Patent No.: US 7,584,846 B2
(45) Date of Patent: Sep. 8, 2009

(54) SHAPED PACKAGING FOR A REFILL

(75) Inventor: L. Nicholas Senter, Beach Park, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 48 days.

(21) Appl. No.: 11/963,364

(22) Filed: Dec. 21, 2007

(65) Prior Publication Data

US 2009/0159486 A1 Jun. 25, 2009

(51) Int. Cl.
*B65D 73/00* (2006.01)

(52) U.S. Cl. ..... 206/457; 206/461; 206/471

(58) Field of Classification Search ..... 222/78, 222/183; 206/471, 462, 461, 459.5, 457, 206/261–271
See application file for complete search history.

(56) References Cited

U.S. PATENT DOCUMENTS 3,780,908 A * 12/1973 Fitzpatrick et al. ..... 221/48
3,861,528 A 1/1975 Damuth
4,784,268 A 11/1988 Perchak
4,901,858 A 2/1990 Anderson
4,905,832 A 3/1990 Boll et al.
5,154,293 A 10/1992 Gould
5,236,749 A 8/1993 Ewing
D352,236 S 11/1994 Althaus
5,439,100 A 8/1995 Gordon et al.
D365,022 S 12/1995 Wada
5,522,505 A 6/1996 Giovannone
5,755,323 A * 5/1998 Zahn et al. ..... 206/318
5,819,917 A * 10/1998 Nicholson ..... 206/38
5,819,939 A 10/1998 Boyer
5,875,934 A * 3/1999 Miller et al. ..... 222/183
6,152,299 A 11/2000 O'Malley et al.
D466,803 S 12/2002 Yang
6,523,689 B2 2/2003 Mickel
D480,300 S 10/2003 Lee (Continued)

FOREIGN PATENT DOCUMENTS

AU 733784 3/1999

(Continued)

OTHER PUBLICATIONS

PCT/US2008/013824 International Search Report and Written Opinion dated Mar. 25, 2009.

*Primary Examiner*—Bryon P Gehman
*Assistant Examiner*—Kaushikkumar Desai

(57) ABSTRACT

A package includes a refill for a device and a configuration of the package that resembles at least a portion of the device with which the refill functionally interacts. The configuration of the package is indicative of the device and does not include same. In addition, a method of identifying a renewable item for a rechargeable device includes the steps of providing a package including a structural configuration that resembles at least a portion of the rechargeable device with which the renewable item interacts and packaging the renewable item within the package. The rechargeable device is not carried by the structural configuration. Further, a packaging includes a first item and a structure that carries the first item and that resembles at least one portion of a second item with which the first item functionally interacts. A characteristic of the structure identifies the second item. The second item is not carried by the structure.

21 Claims, 9 Drawing Sheets

U.S. PATENT DOCUMENTS

| | | | | |
|---|---|---|---|---|
| D480,638 | S | 10/2003 | Lee | |
| D480,964 | S | 10/2003 | Lee | |
| 6,814,238 | B2 | 11/2004 | Lee | |
| D511,452 | S | 11/2005 | Dibnah et al. | |
| D517,909 | S | 3/2006 | Kent et al. | |
| D522,380 | S | 6/2006 | Dibnah et al. | |
| D535,004 | S | 1/2007 | Furner et al. | |
| D538,915 | S | 3/2007 | Anderson et al. | |
| 7,410,056 | B2 * | 8/2008 | Cafferata et al. | 206/471 |
| 2004/0079668 | A1 | 4/2004 | Lee | |
| 2004/0206772 | A1 | 10/2004 | Leifheit | |
| 2005/0109658 | A1 | 5/2005 | Bindford | |
| 2005/0269232 | A1 | 12/2005 | Eisenbraun | |
| 2006/0091037 | A1 | 5/2006 | Grote et al. | |
| 2007/0029223 | A1 | 2/2007 | Mazurek | |
| 2007/0051652 | A1 | 3/2007 | Tilton | |
| 2007/0102317 | A1 | 5/2007 | Crawford et al. | |
| 2007/0187274 | A1 * | 8/2007 | Dalea et al. | 206/471 |
| 2008/0054018 | A1 * | 3/2008 | Stechschulte et al. | 222/78 |

FOREIGN PATENT DOCUMENTS

| | | | |
|---|---|---|---|
| AU | 149717 | S | 10/2002 |
| AU | 149718 | S | 10/2002 |
| AU | 150973 | | 3/2003 |
| AU | 300101 | | 8/2004 |
| AU | 302118 | | 6/2005 |
| AU | 304023 | | 11/2005 |
| AU | 312641 | | 1/2007 |
| AU | 313093 | | 2/2007 |
| AU | 313386 | | 3/2007 |
| AU | 316320 | | 9/2007 |
| CR | 14680 | | 9/1983 |
| CR | 28494 | | 2/1999 |
| DE | 74 36 038 | | 3/1975 |
| DE | 33 25 617 | | 1/1985 |
| DE | 40200788 | | 5/2002 |
| DE | 40401821 | | 7/2004 |
| DE | 40406984 | | 4/2005 |
| DE | 40402928 | | 7/2005 |
| DE | 40403011 | | 7/2005 |
| DE | 40600348 | | 7/2006 |
| DE | 40603295 | | 1/2007 |
| DE | 40700820 | | 5/2007 |
| DM | 047254 | | 6/1999 |
| DM | 052947 | | 11/2000 |
| DM | 054163 | | 2/2001 |
| DM | 054317 | | 2/2001 |
| DM | 054784 | | 3/2001 |
| DM | 055342 | | 4/2001 |
| DM | 060622 | | 8/2002 |
| DM | 064257 | | 10/2003 |
| DM | 066517 | | 7/2005 |
| DM | 068167 | | 10/2006 |
| EC | 56155-0001 | | 7/2003 |
| EC | 85170-0001 | | 10/2003 |
| EC | 177506-0001 | | 5/2004 |
| EC | 195755-0001 | | 6/2004 |
| EC | 530175-0001 | | 5/2006 |
| EC | 657440-0001 | | 1/2007 |
| EP | 327 479 | | 8/1989 |
| EP | 605 880 | | 7/1994 |
| EP | 856 476 | | 8/1998 |
| GB | 2040236 | | 11/1994 |
| GB | 2051003 | | 2/1996 |
| GB | 2066620 | | 9/1997 |
| GB | 3008425 | | 3/2003 |
| GB | 3019663 | | 2/2005 |
| GB | 3025331 | | 9/2006 |
| HK | 0110087.0 | | 1/2001 |
| HK | 0310456.4M002 | | 3/2003 |
| JP | 835173 | | 1/1992 |
| JP | 859634 | | 10/1992 |
| JP | 898443 | | 2/1994 |
| JP | 907544 | | 6/1994 |
| JP | 964594 | | 7/1996 |
| JP | 982981 | | 4/1997 |
| JP | 1024821 | | 8/1998 |
| JP | 1026190 | | 9/1998 |
| JP | 1067263 | | 1/2000 |
| JP | 1067264 | | 1/2000 |
| JP | 1067265 | | 1/2000 |
| JP | 1067266 | | 1/2000 |
| JP | 1068010 | | 1/2000 |
| JP | 1070248 | | 2/2000 |
| JP | 1070268 | | 2/2000 |
| JP | 1096994 | | 11/2000 |
| JP | 1101014 | | 12/2000 |
| JP | 1109153 | | 3/2001 |
| JP | 1122714 | | 8/2001 |
| JP | 1134160 | | 12/2001 |
| JP | 1140255 | | 3/2002 |
| JP | 1141991 | | 3/2002 |
| JP | 1142497 | | 4/2002 |
| JP | 1151942 | | 7/2002 |
| JP | 1162918 | | 11/2002 |
| JP | 1162919 | | 11/2002 |
| JP | 1162920 | | 11/2002 |
| JP | 1193401 | | 11/2003 |
| JP | 1193977 | | 11/2003 |
| JP | 1193978 | | 11/2003 |
| JP | 1205787 | | 4/2004 |
| JP | 1206993 | | 4/2004 |
| JP | 1206994 | | 4/2004 |
| JP | 1206995 | | 4/2004 |
| JP | 1225241 | | 10/2004 |
| JP | 1257255 | | 10/2005 |
| JP | 1258755 | | 11/2005 |
| JP | 1259609 | | 11/2005 |
| JP | 1259611 | | 11/2005 |
| JP | 1271452 | | 3/2006 |
| JP | 1271621 | | 3/2006 |
| JP | 1271624 | | 3/2006 |
| JP | 1271810 | | 4/2006 |
| JP | 1285325 | | 9/2006 |
| JP | 1288827 | | 11/2006 |
| JP | 1289064 | | 11/2006 |
| JP | 1309989 | | 8/2007 |
| KR | 30-0229727 | | 10/1998 |
| KR | 30-0234035 | | 12/1998 |
| KR | 30-0234036 | | 12/1998 |
| KR | 30-0286166 | | 11/2001 |
| KR | 30-0295755 | | 3/2002 |
| KR | 10-2002-0059757 | | 7/2002 |
| KR | 20-0305978 | | 2/2003 |
| KR | 30-0362445 | | 9/2004 |
| KR | 10-2004-0111550 | | 12/2004 |
| KR | 10-2005-0095626 | | 9/2005 |
| KR | 20-0396262 | | 9/2005 |
| KR | 30-0394860 | | 10/2005 |
| KR | 10-2005-0103948 | | 11/2005 |
| KR | 10-2005-0119637 | | 12/2005 |
| KR | 10-2006-0069820 | | 6/2006 |
| KR | 30-0433061 | | 12/2006 |
| KR | 30-0442917 | | 3/2007 |
| KR | 30-0442918 | | 3/2007 |
| KR | 10-0092997 | | 9/2007 |
| MX | 9116 | | 11/1997 |
| MX | PA 02009228 | | 3/2003 |
| MX | 234802 | | 3/2006 |
| SG | DU2005/1314 I | | 7/2005 |
| WO | WO 99/007619 | | 2/1999 |
| WO | WO 01/36293 | | 5/2001 |
| WO | WO 03/091019 | | 11/2003 |

| | | |
|---|---|---|
| WO | WO 2004/067041 | 8/2004 |
| WO | WO 2004/074131 | 9/2004 |
| WO | WO2004/102698 | 11/2004 |
| WO | WO 2005/011373 | 2/2005 |
| WO | WO2006/020075 | 2/2006 |

* cited by examiner

SHAPED PACKAGING FOR A REFILL

CROSS REFERENCE TO RELATED APPLICATIONS

Not Applicable

REFERENCE REGARDING FEDERALLY SPONSORED RESEARCH OR DEVELOPMENT

Not Applicable

SEQUENTIAL LISTING

Not Applicable

BACKGROUND OF THE INVENTION

Field of the Background

The present disclosure relates generally to packaging for a refill, and more particularly, to a package shaped to resemble a device for use with a refill.

SUMMARY OF THE INVENTION

In one embodiment, a package includes a configuration of the package that resembles at least a portion of a device with which a refill functionally interacts. The configuration of the package is indicative of the device. Further, the configuration does not carry the device.

In a different embodiment, a method of identifying a renewable item for a rechargeable device includes the step of providing a package having a structural configuration that resembles at least a portion of the rechargeable device with which the renewable item interacts. The method further includes the step of packaging the renewable item within the package. The rechargeable device is not carried by the structural configuration.

In another embodiment, a packaging includes a first item and a structure that carries the first item and that resembles at least one portion of a second item with which the first item functionally interacts. A characteristic of the structure identifies the second item. The second item is not carried by the structure.

Other aspects and advantages of the present invention will become apparent upon consideration of the following detailed description.

BRIEF DESCRIPTION OF THE DRAWINGS

FIG. 1 is an isometric view of one embodiment of a package for a refill having a configuration resembling a portion of a device that the refill is to be used with;

FIG. 11 is an isometric view of still another embodiment of a package for a refill having a configuration resembling a portion of a device that the refill is to be used with;

FIG. 12 is an isometric view of yet another embodiment of a package for a refill having a configuration resembling a portion of a device that the refill is to be used with;

FIG. 13 is an isometric view of another embodiment of a package for a refill having a configuration resembling a portion of a device that the refill is to be used with; and FIG. 14 is an isometric view of a different embodiment of a package for a refill having a configuration resembling a portion of a device that the refill is to be used with.

DETAILED DESCRIPTION

Figure 1:
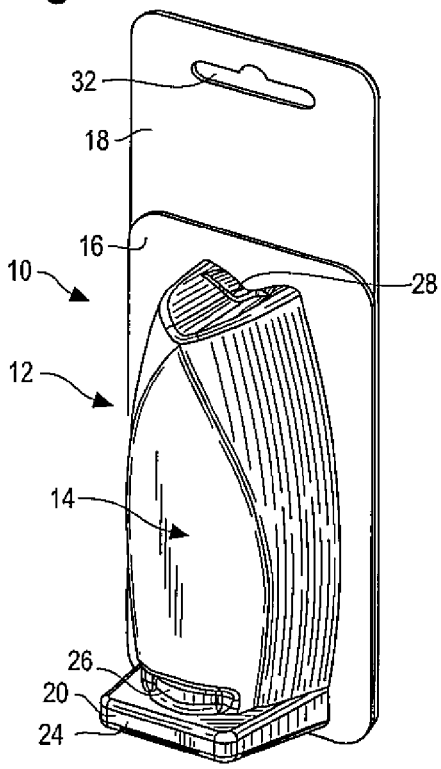
Figure 4:
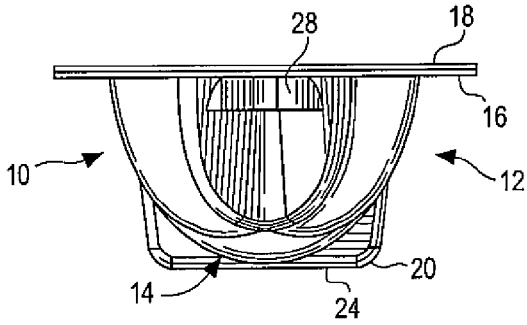
FIG. 4 is a top plan view of the package of FIG. 1.
Figure 5:
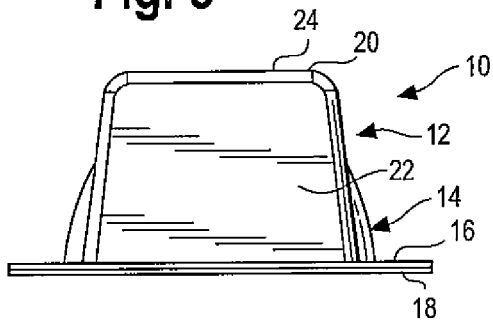
FIG. 5 is a bottom elevational view of the package of FIG. 1.
Figure 2:
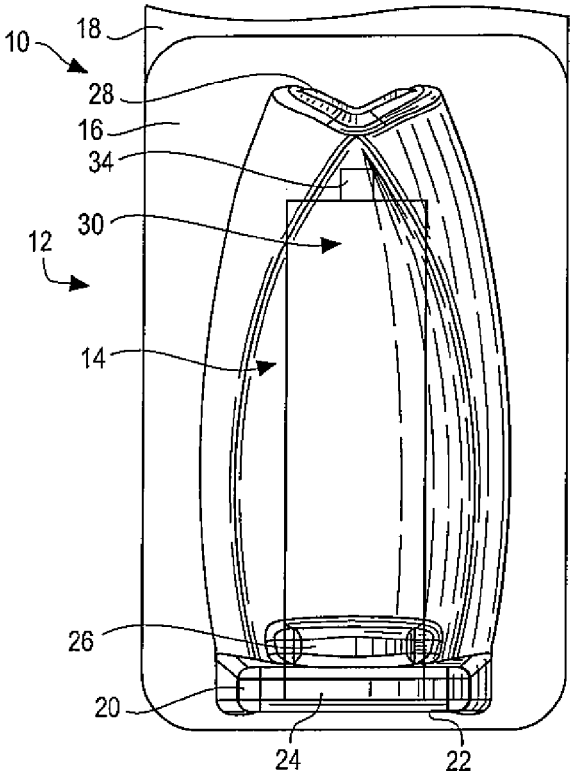
FIG. 2 is a front elevational view of the package of FIG. 1 further including a refill.
Figure 3:
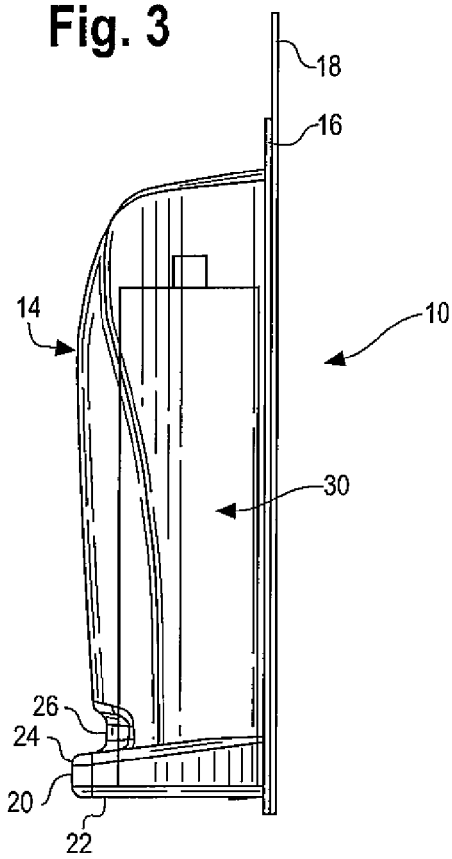
FIG. 3 is a right side elevational view of the package of FIG. 1 further including a refill, the opposite side being a mirror image of the right side view.

Consumers are often overwhelmed with the number of choices available for refill containers for consumer products such as aerosol dispensers. As a result consumers may be confused about which refill to buy to replace an empty refill and therefore may purchase an incompatible refill for their aerosol dispenser. Realization of the mistake typically only occurs once the consumer has returned home, which takes a considerable amount of time, and attempting to recharge the aerosol dispenser with the incorrect refill. As a result, the consumer must return to the store to exchange the incorrect refill with a compatible refill. However, the consumer at this point is again faced with choosing the correct refill. The present disclosure overcomes the burden placed upon consumers of identifying refills and other items, such as renewable items, by providing packaging that guides a consumer to identify refills and the like that are compatible with aerosol dispensers and other devices.

The present disclosure is directed toward packages and packaging. The present disclosure is further directed toward using packaging to provide guidance to a consumer to identify a product to be used with a device. In one embodiment, a package containing the product may resemble or may be reminiscent or indicative of the device with which it is used. The package may have a configuration or characteristic such as at least one of a three dimensional shape, a size, a pattern, an outline, an exterior, a facade, a surface, a footprint, a contour, and the like that resembles and/or somehow suggests a reusable appliance for which the refill is designed. For example, the package may have one or more configurations, such as a three dimensional configuration, which resembles a portion of the outer surface of the device of sufficient completeness to enable a consumer to recognize the device. It is contemplated that the configuration may appear to be a replica of the exterior of the device and made from, for example, thermoformed materials, such as plastic and the like. Further, the configuration may resemble another portion of the device such as a compartment and/or an interface where the product would functionally interact when assembled with the device. As contemplated herein, at least one portion of the package, such as the configuration, is shaped and/or formed such that a consumer will recognize a structural signature characteristic of the device. Thus, by association of the shape and/or form of the device presented by the configuration of the package, a consumer may identify the product needed to replenish the device. Further, due to the consumer being able to identify the device by a shape of a portion of the package, the device itself need not be included with the package. However, it is contemplated that the package may include the device, as well.

In another embodiment, in lieu of or in addition to the configuration having an exterior surface or structural shape suggestive of the device, the configuration may resemble a structure for which the shape of some portion of the product is its complement. For example, the configuration may resemble any type of lock and key arrangement of a device. In one embodiment, the device and lock and key arrangement are similar to those shown in U.S. patent application Ser. No. 11/725,402, which is herein incorporated by reference in its entirety. In this way, devices for which it would be impractical and/or undesirable for any reason to mimic the outer surfaces thereof may be represented sufficiently by shaping the configuration to resemble a smaller but singularly identifiable component of the device that a consumer may associate therewith.

Refills and renewable devices contemplated herein may include, for example, products that may be carried by the package including, for example, a component, an insert, a packet, a pouch, a storage container, a textile, a bead, a candle, a recharge, an add-on, a replacement part, a single or multiple compartment cartridge, a can, a bottle, an aerosol container, a fuel charge, a filter, a bag, a reservoir, a reusable part, a liquid fragrance reservoir, a fluid container, and/or a pump-type sprayer container, any of which may have any size and/or volume known to those skilled in the art.

Certain products may carry a dispensable substance including, for example, a fluid, a gas, a fragrance, a gel, an oil, an emulsion, a wax, a resin, a polymer, a salt, a powder, a shaving gel, an insect repellent, an insecticide, an air controlling agent an odor eliminating agent, a cleaning agent, a clog removal agent, a scrubbing agent, a surface cleaning agent, a floor cleaning agent, a dust removal agent, a bathroom cleaning agent, a stain removal agent, a clothes cleaning agent, a food, a drink mix, an ingredient any combination thereof, and any other suitable substance. In one embodiment, the fluid may be a fragrance, an odor eliminator, or an insecticide disposed within a carrier liquid, a deodorizing liquid, or the like. For example, the fluid may comprise OUST®, an air and carpet sanitizer for household, commercial, and institutional use, or GLADE®, a household deodorant, both sold by S. C. Johnson and Son, Inc., of Racine, Wis. The fluid and/or other substance may also comprise other actives, such as sanitizers, air fresheners, odor eliminators, mold or mildew inhibitors, insect repellents, and the like, or that have aromatherapeutic properties. The fluid alternatively may comprise any fluid known to those skilled in the art that can be dispensed from a container.

Devices and/or items contemplated herein may include a dispenser, such as a fluid dispenser, an aerosol dispenser, a gas dispenser, a powder dispenser, a dispenser of solids, a liquid dispenser, a coffee and/or espresso machine, a motorized machine, an electronic device, a cosmetic device, a cooking appliance, a filtering system, a chamber, a razor, a carrier, a candle, and/or any other apparatus known in the art that requires replacement of a temporary, short-lived, and/or single use product, such as a rechargeable device, and thereby dispenses, stores, displays, prepares, applies, or otherwise utilizes the product and/or any substance held within the product.

Examples of aerosol dispensers include manual dispensers controlled by manual actuation of a switch or button and automated aerosol dispensers controlled by sensors, timers, and the like. An example of a gas dispenser includes a gas regulator valve. Examples of powder dispensers and/or dispensers of solids include hand-held shakers, cosmetic brushes that dispense powders, sifters, and the like. Examples of coffee and/or espresso machines include those that dispense and/or prepare prepackaged coffee, espresso, and/or flavor packs and the like, and combinations thereof. Examples of motorized machines, electronic devices, filtering systems, chambers, carriers, razors, devices that use temporary, short-lived product, and/or single use products, and devices that dispense, store, prepare, and/or apply, or otherwise utilize the product and/or any substance held within the product are known to those skilled in the art.

The package may be made of any suitable material known to one skilled in the art including paper, plastic, cloth, cardboard, wood, metal, resin, and any combination thereof. Further, it is contemplated that the packaging may be formed by any method appropriate to achieve the desired shape in light of the starting materials disclosed above. For example, the package may be made by thermoforming, injection molding, extruding, laminating, and combinations thereof including other suitable methods known in the art. In addition, it is contemplated herein that the product may be fully contained and carried within the package or may be only partially contained thereby to securely carry the product so the product is not inadvertently separated from the package before purchase. The package or materials from which the package is made may be transparent, translucent, and/or opaque to enable, allow, and/or restrict viewing of at least a portion of an interior of the package.

Turning to the figures, FIGS. 1-14 depict certain embodiments of those contemplated in the present disclosure. These embodiments only illustrate a few of the refill types and package configurations of the many contemplated herein and are not to be considered limiting in any way to the extent of the present disclosure. For example, FIGS. 1-6 depict a first embodiment of a package 10 that includes a thermoformed blister-type portion 12 having a configuration 14 that resembles outer surfaces of an aerosol dispenser and a back flange 16 that may be secured to a backing material 18, such as paper, cardboard, and/or plastic and the like. The thermoformed portion 12 further includes a foot 20 with a bottom surface 22 that enables the package to be displayed in a manner similar to how an actual aerosol dispenser would appear in use, e.g., resting upon a supporting surface (not shown). In a different embodiment, alternative or similar structure is provided to display the package in a manner similar to how a different type of device would appear in use. In some embodiments, the foot 20 includes protrusions (not shown) on the bottom surface 22 that help to stabilize the package 10 when resting on a supporting surface (not shown). Further, the foot 20 includes a face surface 24 that may enable a vendor to display a number of similar packages 10 on a supporting surface (not shown) such that the packages align with their face surfaces aligned in parallel when the packages are aligned in a row front to back.

The package 10 further includes denesting features 26 and 28 located toward the bottom and the top, respectively, of the thermoformed portion 12. The denesting features 26 and 28 aid in the assembly of the packages 10 by allowing the thermoformed portions 12 to be easily stacked and unstacked, when storing and loading the packages, respectively, prior to affixation of a backing material 18. Another function of the denesting features 26 and 28 may be to help secure a refill 30 within the configuration 14 of the thermoformed portion 12 in a manner similar to how the refill 30 would be positioned relative to the device for which the refill is designed (not shown). The backing material 18 also includes an aperture 32 to aid in displaying the package 10, e.g., by enabling the package 10 to be hung in a display rack (not shown).

Figure 6:
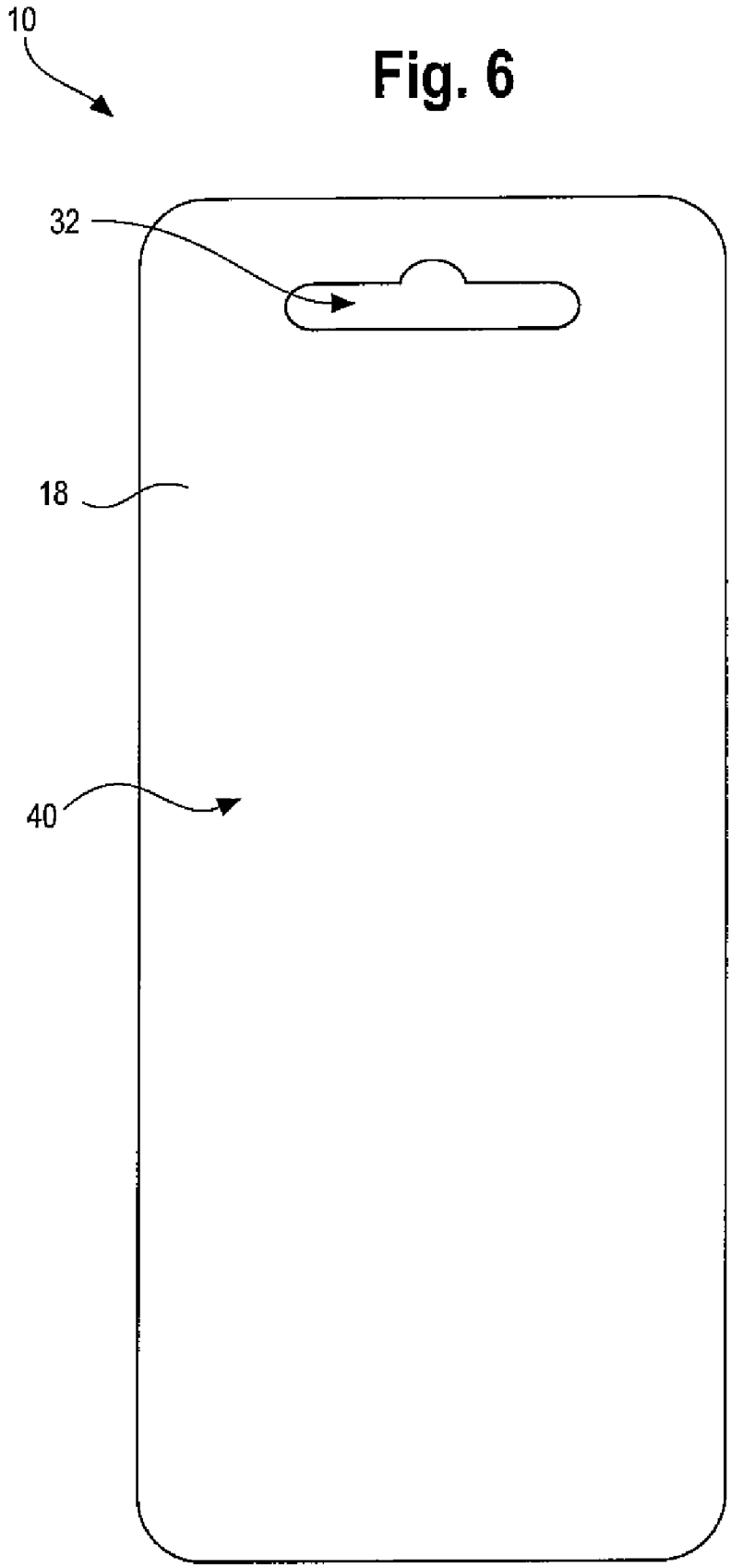
FIG. 6 is a rear elevational view of the package of FIG. 1.

FIG. 6 depicts a rear view of the package 10. A back surface 40 of the backing material 18 is shown through which the aperture 30 extends. The back surface 40 may be provided with additional information regarding the refill and/or device for which the refill is designed. However, while not wishing to be bound by theory, it is believed that no additional information may be necessary for a consumer to choose the correct refill carried by the package 10, as the configuration 14 provides an adequate cue to the consumer to recognize which refill to choose. In this way, it may be the case that the only additional information that is provided on the back surface 40 may be, for example, the fragrance of the refill in question and other information relating to characteristics of the refill rather than which device it is designed for.

Figure 7:
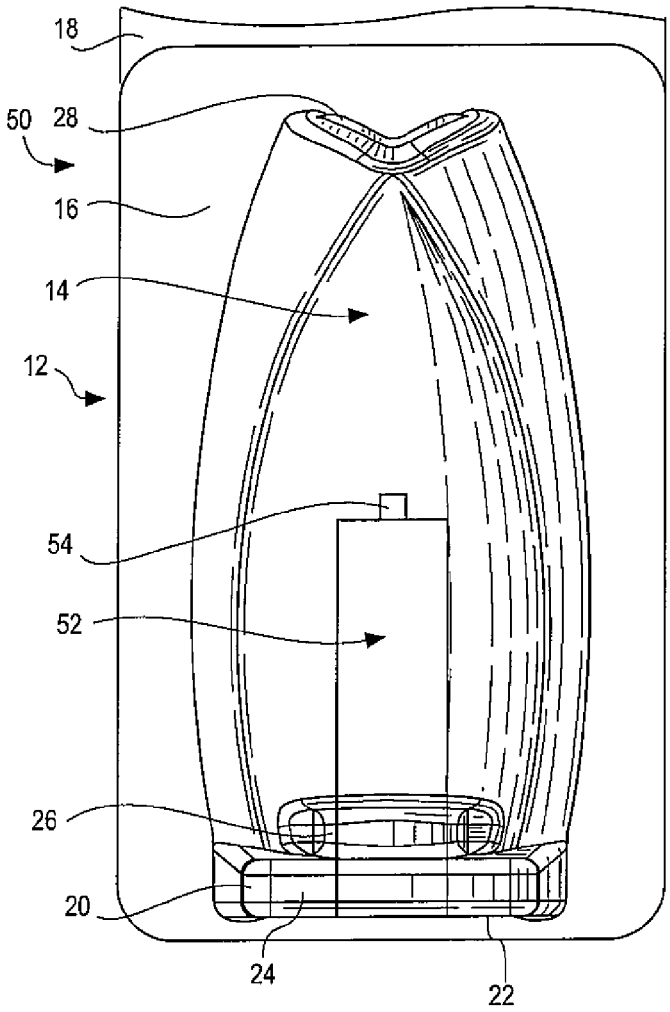
FIG. 7 is a front elevational view of a different embodiment of a package similar to the one shown in FIG. 2.

FIG. 7 depicts another embodiment of a package 50 similar to that shown in FIGS. 1-6, wherein identical structures in other embodiments are shown with like reference numerals. The present embodiment includes an aerosol refill 52 with a fluid outlet 54, such as a nozzle, a wick, a capillary member, a tube, a valve, and the like. The refill 52 is carried within the configuration 14 of the thermoformed portion 12 of the package 10. Further, the configuration 14 of the package 10 approximates the actual aerosol dispenser size for which the aerosol refill 52 is designed. However, it is contemplated that the configuration 14 may be scaled in size with respect to the actual device, such that the configuration may be relatively larger (not shown) or smaller (see FIG. 8) than the actual device represented.

Figure 8:
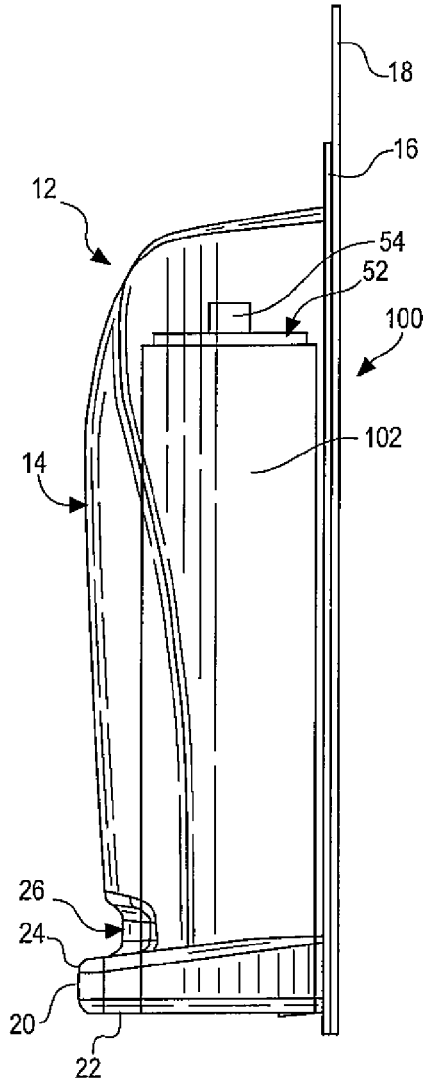
FIG. 8 is a right side elevational view of another embodiment of a package similar to the one shown in FIG. 3.

FIG. 8 shows a different embodiment of a package 100 that includes an insert 102, which may be made of paper, cardboard, plastic, cloth, metal, resin, and/or any other materials known in the art and any combination thereof. The insert 102 serves to secure the refill 52 within the package 100, and may provide information regarding the refill and/or device, and/or instructions for combining the refill with the device. For example, FIG. 8 illustrates the insert 102 helping to secure the refill 52 in place within the package 100.

Figure 9:
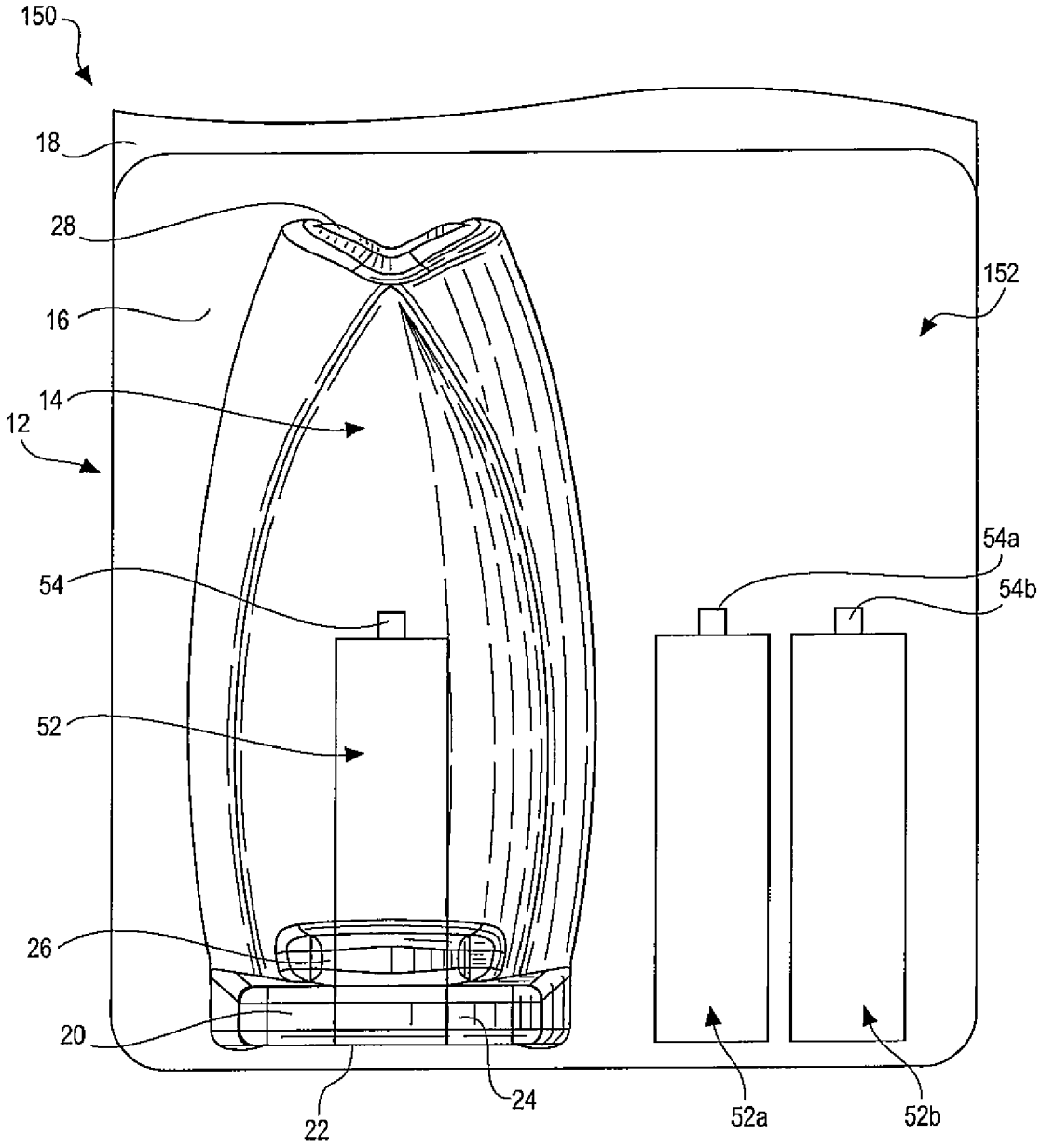
FIG. 9 is a front elevational view of another embodiment of a package having a refill within a configuration that resembles a portion of a device with which the refill is to be used and an additional storage portion containing two additional refills.
Figure 10:
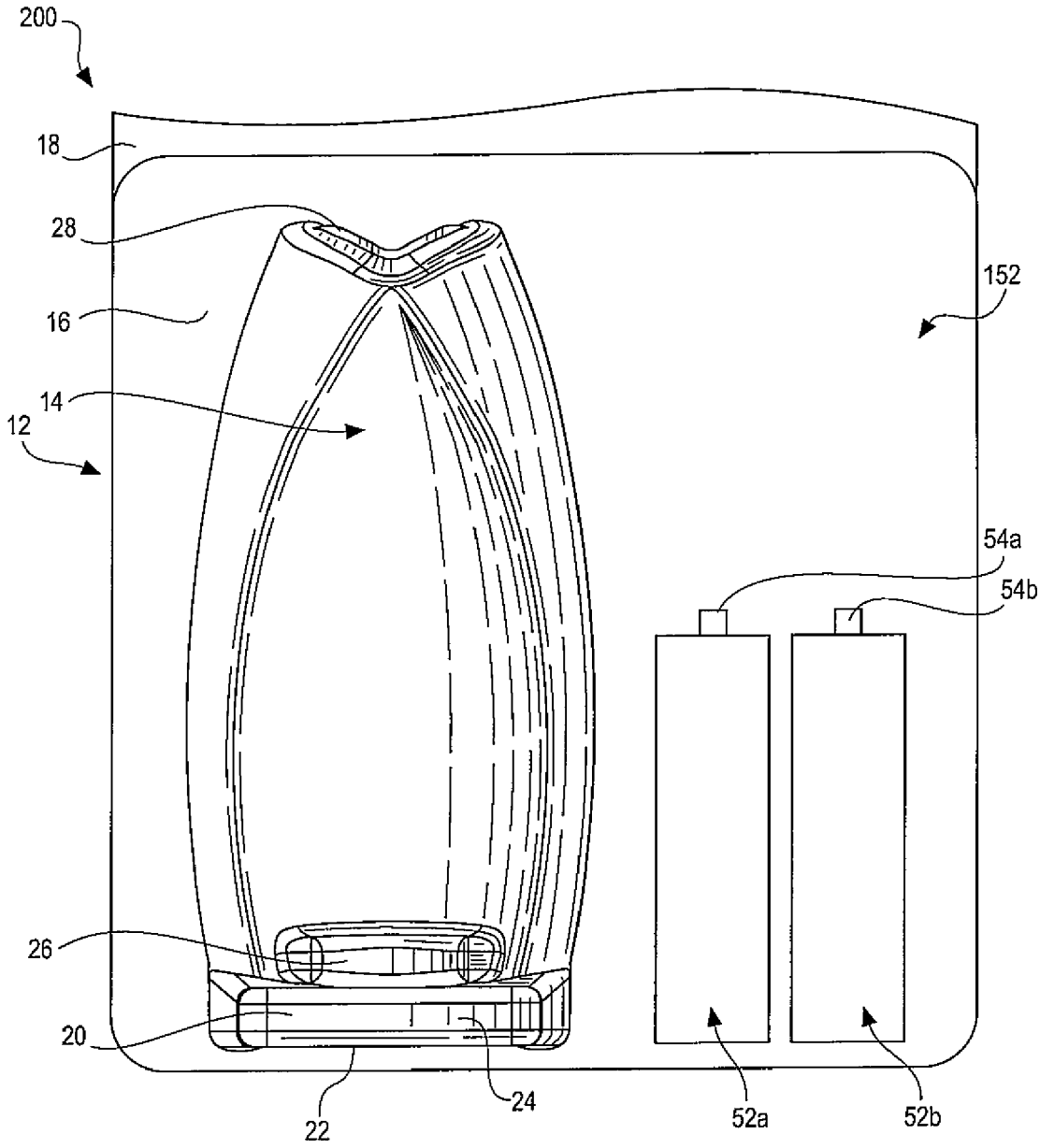
FIG. 10 is a front elevational view of a different embodiment of a package similar to the one shown in FIG. 9 except that the refill is removed from the configuration.

FIG. 9 illustrates another embodiment of a package 150 having similarities to those described previously. The package 150 further includes an additional storage portion 152 that may carry one or more additional refills (in this case two additional refills, 52*a* and 52*b* with fluid outlets 54*a* and 54*b*, respectively). The additional storage portion 152 may be an additional portion of the thermoformed portion 12, such that it is an extension thereof. Alternatively, it is contemplated herein that the additional storage portion may be a separate feature of the package 150 associated with the backing material 18. Further, the additional storage portion 152 may completely surround the additional refills, 52*a* and 52*b*, or may only carry a portion of each sufficient to secure the additional refills to the package 150. The advantage of this embodiment is that a consumer may be guided to purchase the correct refill 52, 52*a*, and 52*b* for a dispenser (not shown) by the configuration 14 and at the same time may purchase several identical refills thus reducing the number of packages. In addition, the package 150 of this embodiment may include refills 52, 52*a*, and 52*b* with differing characteristics, such as differing fragrances and/or differing uses, such as fragrancing, insect repelling, and/or deodorizing, and the like. FIG. 10 depicts a different embodiment of a package 200 similar to the own shown in FIG. 9, except that the refill 52 is not provided within the package 200. Rather, only the refills 52*a* and 52*b* are provided on the storage portion 152 and the thermoformed portion 12 and the configuration 14 act as an indicator of the type of device to be used with the refills. It is contemplated that the thermoformed portions 12 and/or the configuration 14 may be scaled larger or smaller in this or other embodiments.

In yet another embodiment (not shown), a package includes a thermoformed portion with a configuration resembling a portion of a device, wherein a refill is carried partially within the thermoformed portion of the package and partially outside of the thermoformed portion. Such an approach may help guide the consumer to choose the correct refill for a device, and further, may instruct how the refill interacts with and/or attaches to the device. Still further, by carrying the refill only partially contained within the package, less packaging material is required thus minimizing use of packaging materials in general.

Figure 11:
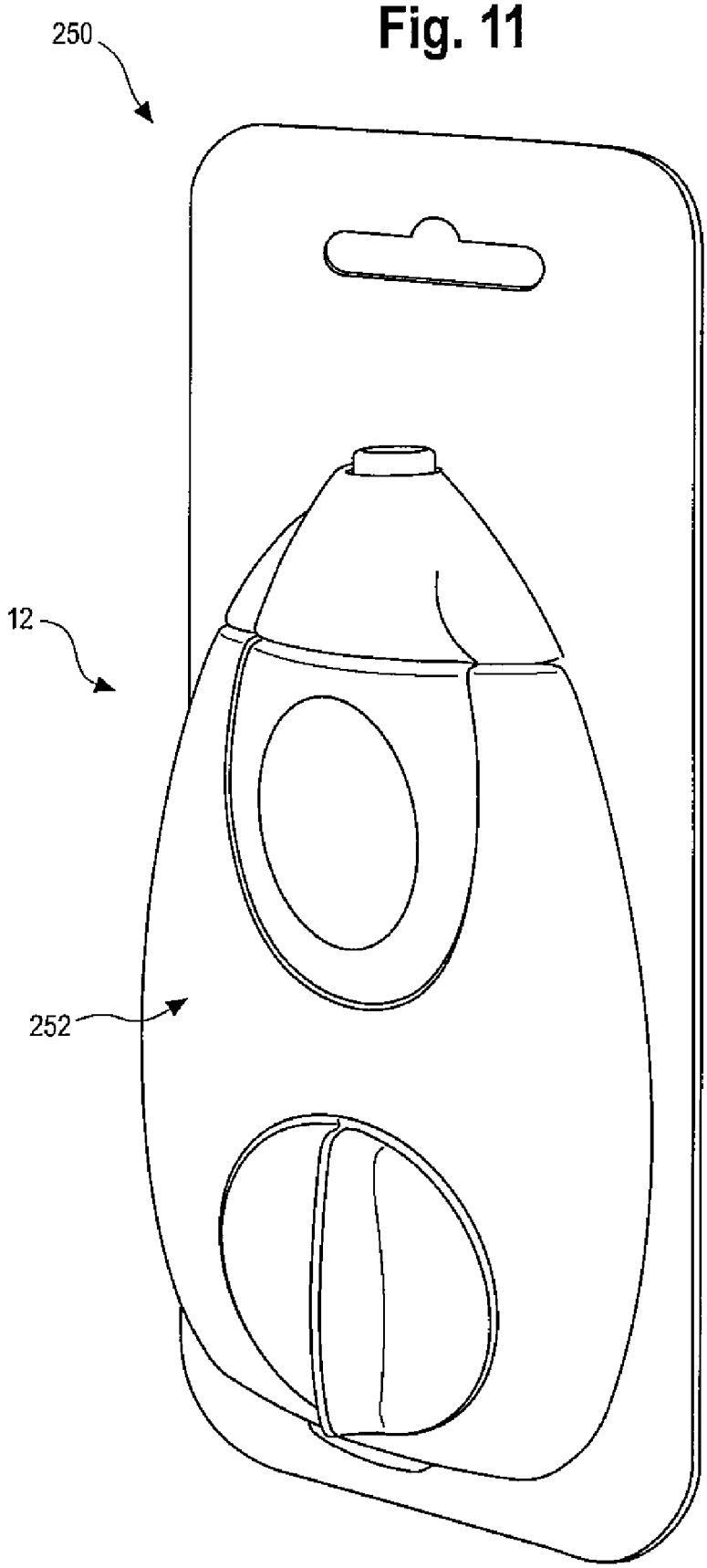
Figure 12:
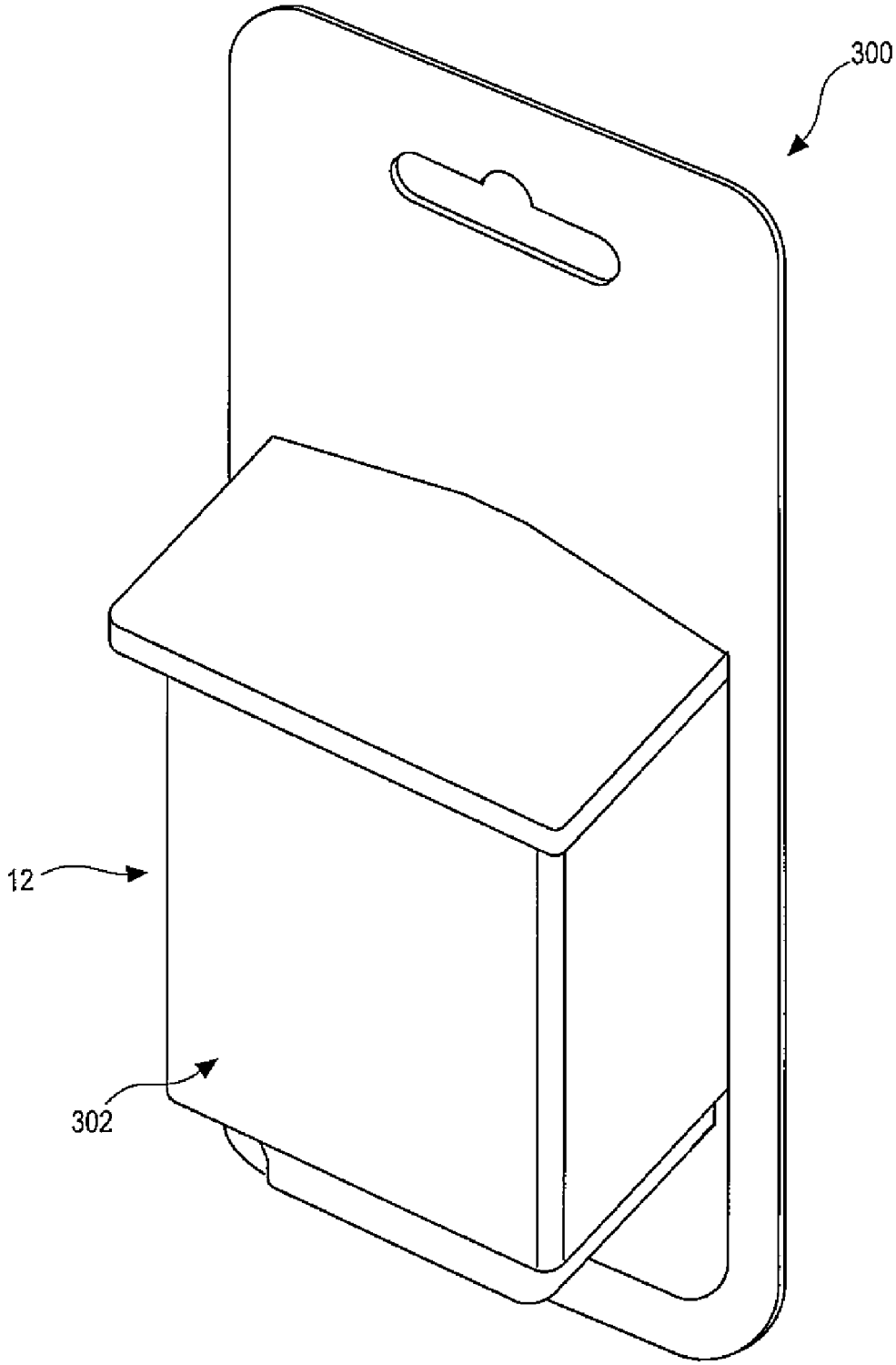
Figure 13:
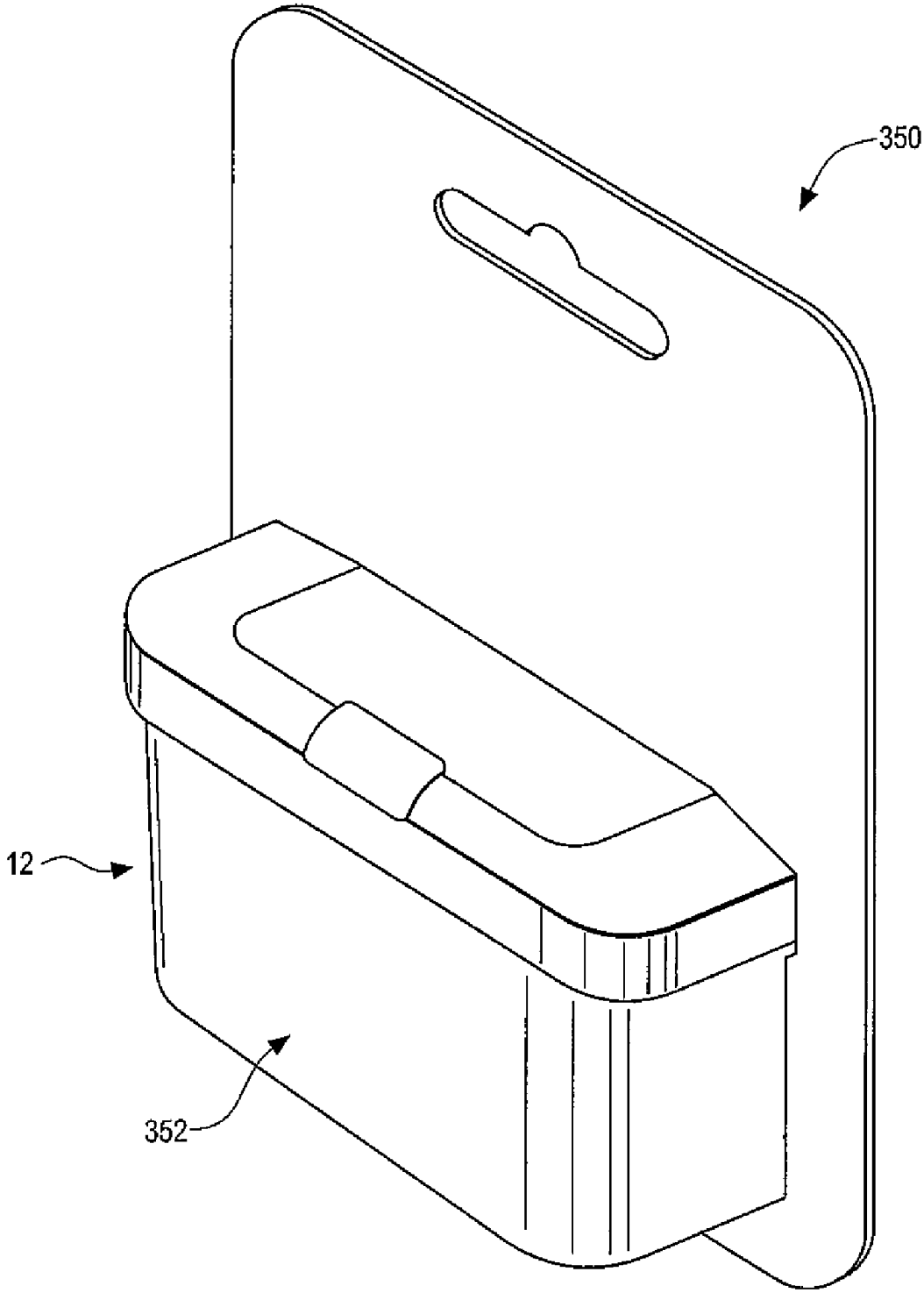
Figure 14:
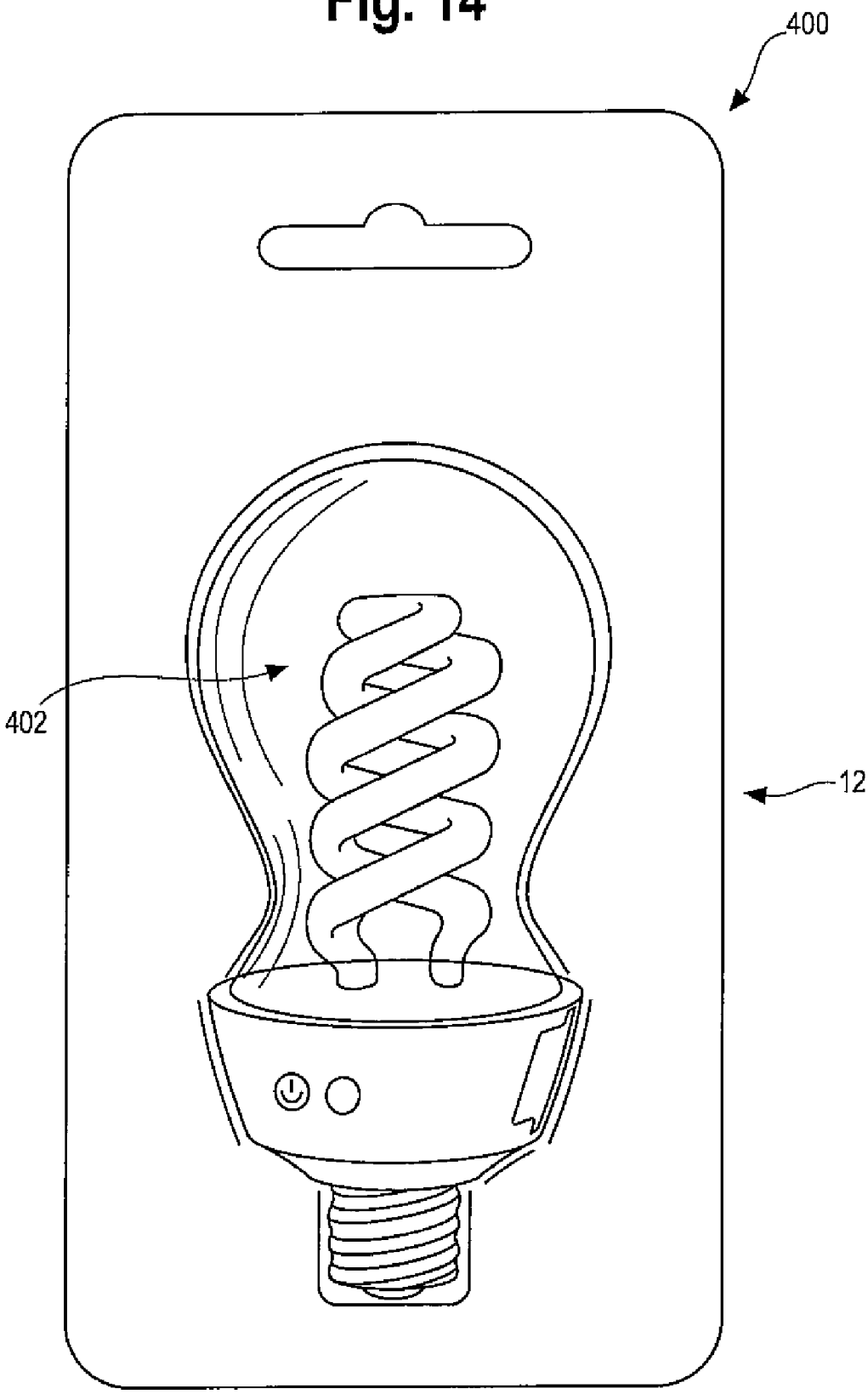

FIGS. 11-14 depict other embodiments of packages having thermoformed portions 12 with configurations that resemble different types of devices. FIG. 11 illustrates a package 250 having a configuration 252 that is indicative of a stain removal device, which may include a refill such as a pad and/or a liquid. FIG. 12 depicts a package 300 having a structural configuration 302 that resembles a portion of a volatile emitting insect control lantern, which may include a renewable item such as a candle and/or a pad. FIG. 13 shows a package 350 having a structure 352 with a characteristic that identifies a baby wipe container, wherein another item such as a refill of wipes that functionally interacts with the container is carried within the package 350. FIG. 14 depicts yet another package 400 having a configuration 402 that resembles a portion of an air freshening and lighting device, which may include a refill such as a fragrance cartridge. FIGS. 11-14 are illustrative of the varying types of packages that may be fashioned to provide an indication to a user of an appropriate refill for a corresponding device.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use that disclosed herein and to teach the best mode of carrying out same. The exclusive rights to all modifications which come within the scope of the appended claims are reserved.

I claim:

1. A package for a refill for a device, comprising:

a refill for the device, and a configuration of the package that resembles at least one portion of the device with which the refill will functionally interact;

wherein the configuration of the package is indicative of the device, and wherein the package does not carry the device, and wherein the refill comprises a dispensable substance that is dispensable therefrom.

2. The package of claim 1, wherein the refill comprises at least one of a component, an insert, a packet, a pouch, a storage container, a textile, a bead, a candle, a recharge. an add-on, a replacement part, a single or multiple compartment cartridge, a can, a bottle, an aerosol container, a fuel charge, a filter, a bag, a reservoir, a reusable part, a liquid fragrance reservoir, and a pump-type sprayer container.

3. The package of claim 1, wherein the refill comprises at least one of a fluid, a gas, a fragrance, a gel, an oil, an emulsion, a wax, a resin, a polymer, a salt, a powder, a shaving gel, an insect repellent, an insecticide, an air controlling agent, an odor eliminating agent, a cleaning agent, a clog removal agent, a scrubbing agent, a surface cleaning agent, a floor cleaning agent, a bathroom cleaning agent, a stain removal agent, a clothes cleaning agent, a dust removal agent, a food, a drink mix, an ingredient, and combinations thereof.

4. The package of claim 1, wherein the refill is an aerosol container having a fluid outlet.

5. The package of claim 1, wherein the appearance of the refill with the configuration enables a user to correctly identify a refill with respect to the specific device.

6. The package of claim 1, wherein a portion of the refill is complementary in shape to the configuration of the package that resembles the at least one portion of the device.

7. The package of claim 1, wherein a portion of the refill is partially contained within the package.

8. The package of claim 7, wherein the refill is viewably disposed within the package to viewably interact with the configuration in a manner similar to its interaction with a portion of the device with which the refill functionally interacts.

9. The package of claim 1, wherein the configuration comprises a three dimensional structure.

10. The package of claim 9, wherein the three dimensional structure resembles a partially disassembled device.

11. The package of claim 10, wherein refill will interact with the at least one portion of the device via a lock and key mechanism.

12. The package of claim 1, wherein the package further comprises an additional storage portion for one or more refills.

13. The package of claim 12, wherein one or more refills are stored in the additional storage portion and no refill is stored within the configuration.

14. The package of claim 1, wherein the configuration is a replica of the device that enables a consumer to correctly identify the refill to be used with the device.

15. The package of claim 1, wherein the device comprises at least one of an acrosol dispenser, a gas dispenser, a powder dispenser. a dispenser of solids, a liquid dispenser, a coffee machine, an espresso machine, a motorized machine, an electronic device, a cosmetic device, a cooking appliance, a filtering system, a chamber, a razor, a carrier, a candle, a device that uses a temporary product, a device that uses a short-lived product, a device that uses a single use product, a dispensing device, a storing device, a preparing device, and an applicator.

16. The package of claim 1, wherein the package comprises at least one of paper, plastic, cloth, cardboard, wood, metal, resin, a recycled material, and combinations thereof.

17. A packaging, comprising:

a first item; and a structure that carries the first item and that resembles at least one portion of a second item with which the first item functionally interacts, wherein a characteristic of the structure identifies the second item and wherein the second item is not carried by the structure, and wherein the first item is an aerosol container having a fluid outlet.

18. A package for a refill for a device, comprising:

a refill for the device, wherein the refill is an aerosol container having a fluid outlet, a configuration of the package that resembles at least a portion of a device with which a refill functionally interacts; and wherein the configuration of the package is indicative of the device and wherein the configuration does not carry the device.

19. The package claim 18, wherein the appearance of the refill with the configuration enables a user to correctly identify the refill with respect to the specific device.

20. The package of claim 18, wherein a portion of the refill is partially contained within the package.

21. The package of claim 18, wherein the configuration comprises a three dimensional structure.

* * * * *

UNITED STATES PATENT AND TRADEMARK OFFICE

CERTIFICATE OF CORRECTION

PATENT NO. : 7,584,846 B2
APPLICATION NO. : 11/963364
DATED : September 8, 2009
INVENTOR(S) : L. Nicholas Senter It is certified that error appears in the above-identified patent and that said Letters Patent is hereby corrected as shown below:

Column 8, Line 25 Claim 18: replace "of a" with --of the--

Column 8, Line 25 Claim 18: replace "which a" with --which the--

Signed and Sealed this

Ninth Day of November, 2010

David J. Kappos

David J. Kappos
*Director of the United States Patent and Trademark Office*